US008961160B2

(12) United States Patent
Calhoun

(10) Patent No.: US 8,961,160 B2
(45) Date of Patent: Feb. 24, 2015

(54) SCROLL PUMP HAVING SEPARABLE ORBITING PLATE SCROLL AND METHOD OF REPLACING TIP SEAL

(71) Applicant: Agilent Technologies, Inc., Loveland, CO (US)

(72) Inventor: John Calhoun, Lexington, MA (US)

(73) Assignee: Agilent Technologies, Inc., Santa Clara, CA (US)

( * ) Notice: Subject to any disclaimer, the term of this patent is extended or adjusted under 35 U.S.C. 154(b) by 108 days.

(21) Appl. No.: 13/853,536

(22) Filed: Mar. 29, 2013

(65) Prior Publication Data

US 2014/0294640 A1 Oct. 2, 2014

(51) Int. Cl.

| | |
|---|---|
| ***F04C 18/02*** | (2006.01) |
| ***F04C 27/00*** | (2006.01) |
| ***F04C 23/00*** | (2006.01) |

(52) U.S. Cl.

CPC ..... *F04C 27/001* (2013.01); *F04C 18/0284* (2013.01); *F04C 23/003* (2013.01)

USPC ..... 418/55.2; 418/55.3; 418/55.4; 418/55.5; 418/22; 418/60

(58) Field of Classification Search

CPC ..... F04C 18/0246; F04C 18/0253; F04C 18/0284; F04C 18/0261; F04C 18/0215; F04C 27/00; F04C 27/001; F04C 23/003; F04C 28/18; F04C 28/24; F04C 28/26; F04C 19/12; F04C 19/124

USPC ..... 418/55.2, 55.4, 55.3, 55.5, 16, 22, 57, 418/60

See application file for complete search history.

(56) References Cited

U.S. PATENT DOCUMENTS

| | | | |
|---|---|---|---|
| 3,817,664 | A | 6/1974 | Bennett et al. |
| 4,650,405 | A | 3/1987 | Iwanami et al. |
| 5,616,015 | A | 4/1997 | Liepert |
| 5,626,469 | A | 5/1997 | Schofield |
| 6,290,477 | B1 | 9/2001 | Gigon |
| 7,261,528 | B2 | 8/2007 | Liepert et al. |
| 7,442,016 | B2 | 10/2008 | Dovey et al. |
| 7,645,130 | B2 | 1/2010 | Sekiya et al. |
| 2007/0224072 | A1 | 9/2007 | Ishikawa et al. |
| 2009/0104061 | A1 | 4/2009 | Haller |
| 2011/0256007 | A1 | 10/2011 | Shaffer |

FOREIGN PATENT DOCUMENTS

| | | |
|---|---|---|
| EP | 0831234 | 3/1998 |
| GB | 2503723 | 8/2014 |

OTHER PUBLICATIONS

Search Report mailed Oct. 17, 2014 in GB Application No. 1403500.0.

*Primary Examiner* — Thomas Denion
*Assistant Examiner* — Xiaoting Hu

(57) ABSTRACT

A scroll pump facilitates the installation of a new tip seal between an axial end of the scroll blade of one of inner stationary and orbiting plate scrolls of the pump and the plate of the other of the inner stationary plate and orbiting plate scrolls. To this end, the orbiting plate scroll has a central portion and an outer peripheral portion extending around and seated on the central portion. The outer peripheral portion of the orbiting plate scroll is keyed to and/or fastened to the central portion such that the outer peripheral portion is not rotatable relative to the central portion and yet is axially removable from the central portion. The tip seal can be readily accessed and replaced by removing the outer peripheral portion of the orbiting scroll plate from the central portion.

20 Claims, 11 Drawing Sheets

SCROLL PUMP HAVING SEPARABLE ORBITING PLATE SCROLL AND METHOD OF REPLACING TIP SEAL

BACKGROUND OF THE INVENTION

1. Field of the Invention

The present invention relates to a scroll pump that includes plate scrolls having nested scroll blades, and a tip seal that provides a seal between the tip of the scroll blade of one of the plate scrolls and the plate of the other plate scroll. The present invention also relates to a multi-stage dry type of scroll pump in which an orbiting plate scroll of the pump has scroll blades at both sides thereof.

2. Description of the Related Art

A scroll pump is a type of pump that includes a stationary plate scroll having a spiral stationary scroll blade, and an orbiting plate scroll having a spiral orbiting scroll blade. The stationary and orbiting scroll blades are nested with a clearance and predetermined relative angular positioning such that a pocket (or pockets) is delimited by and between the scroll blades. The scroll pump also has a frame to which the stationary plate scroll is fixed and an eccentric drive mechanism supported by the frame. These parts generally make up an assembly that may be referred to as a pump head (assembly) of the scroll pump.

The orbiting scroll plate and hence, the orbiting scroll blade, is coupled to and driven by the eccentric driving mechanism so as to orbit about a longitudinal axis of the pump passing through the axial center of the stationary scroll blade. The volume of the pocket(s) delimited by the scroll blades of the pump is varied as the orbiting scroll blade moves relative to the stationary scroll blade. The orbiting motion of the orbiting scroll blade also causes the pocket(s) to move within the pump head assembly such that the pocket(s) is selectively placed in open communication with an inlet and outlet of the scroll pump.

In an example of such a scroll pump, the motion of the orbiting scroll blade relative to the stationary scroll blade causes a pocket sealed off from the outlet of the pump and in open communication with the inlet of the pump to expand. Accordingly, fluid is drawn into the pocket through the inlet. Then the pocket is moved to a position at which it is sealed off from the inlet of the pump and is in open communication with the outlet of the pump, and at the same time the pocket is collapsed. Thus, the fluid in the pocket is compressed and thereby discharged through the outlet of the pump. The sidewall surfaces of the stationary orbiting scroll blades need not contact each other to form a satisfactory pocket(s). Rather, a minute clearance may be maintained between the sidewall surfaces at the ends of the pocket(s).

Oil may be used to create a seal between the stationary and orbiting plate scroll blades, i.e., to form a seal(s) that delimits the pocket(s) with the scroll blades. On the other hand, certain types of scroll pumps, referred to as "dry" scroll pumps, avoid the use of oil because oil may contaminate the fluid being worked by the pump. Instead of oil, dry scroll pumps employ a tip seal or seals each seated in a groove extending in and along the length of the tip (axial end) of a respective one of the scroll blades (the groove thus also having the form of a spiral). More specifically, each tip seal is provided between the tip of the scroll blade of a respective one of the plate scrolls and the plate of the other of the plate scrolls, to create a seal which maintains the pocket(s) between the stationary and orbiting scroll blades. Such tip seals may wear out over time and thus, require periodic replacement.

A scroll pump as described above may be of a vacuum type, in which case the inlet of the pump is connected to a chamber that is to be evacuated. Conversely, the scroll pump may be of a compressor type, in which case the outlet of the pump is connected to a chamber that is to be supplied with fluid by the pump.

Furthermore, a scroll pump may also be configured as a multi-stage type to provide multiple stages of compression and/or to provide a greater capacity (displacement) for the pump. To this end, a scroll pump may have two stationary plate scrolls and an orbiting plate scroll interposed between the stationary plate scrolls. The orbiting plate scroll has a plate, and orbiting scroll blades projecting from both sides of the plate, respectively. Each of the orbiting scroll blades is nested with the stationary scroll blade of a respective one of the stationary plate scrolls. Therefore, several tip seals may be provided in a dry type of multi-stage scroll pump.

SUMMARY OF THE INVENTION

It is an object of the present invention to provide a scroll pump having an inner stationary plate scroll and an orbiting plate scroll, and which facilitates the installation of a new tip seal between an axial end of the scroll blade of one of the stationary and orbiting plate scrolls and the plate of the other of the stationary plate and orbiting plate scrolls.

It is likewise another object of the present invention to provide a method of replacing a tip seal in a scroll pump, which does not require complicated and/or difficult disassembly/reassembly processes such as the disassembly/reassembly of bearings.

According to a first aspect of the present invention, there is provided a dry type of scroll pump comprising an orbiting plate scroll having a central portion and an outer peripheral portion extending around and seated on the central portion. In addition, the outer peripheral portion of the orbiting plate scroll is keyed to and/or fastened to the central portion such that the outer peripheral portion is not rotatable relative to the central portion and yet is axially removable from the central portion.

A scroll pump, according to the first aspect of the invention, also has a frame, an inner stationary plate scroll fixed to the frame, an eccentric drive mechanism supported by the frame, and a tip seal. The inner stationary plate scroll includes a stationary plate having an outer side and an inner side, and a stationary scroll blade projecting axially (parallel to a longitudinal axis of the pump) in a first direction from the outer side of the stationary plate. The orbiting plate scroll includes an orbiting plate having an outer side and an inner side, and an orbiting scroll blade projecting axially in a second direction, opposite the first direction, from the inner side of the orbiting plate. The orbiting scroll blade is juxtaposed with the stationary scroll blade in a radial direction of the pump such that the stationary and orbiting scroll blades are nested.

The tip seal is interposed between an axial end of the scroll blade of one of the stationary and orbiting plate scrolls and the plate of the other of the stationary plate and orbiting plate scrolls, in this case, the central portion of the orbiting plate scroll is constituted by a central section of the orbiting plate. The eccentric drive mechanism is connected to the orbiting plate scroll at the central section of the orbiting plate. On the other hand, the outer portion of the orbiting scroll plate is constituted by an annular section of the orbiting plate and the orbiting scroll blade.

Accordingly, the tip seal is accessible by removing the outer peripheral portion of the orbiting plate scroll from the central portion thereof.

The scroll pump may also be a multi-stage scroll pump. In this case, the scroll pump has both an inner stationary plate scroll fixed to the frame and an outer stationary plate scroll detachably mounted to the frame. The inner stationary plate scroll includes a first stationary plate having an outer side and an inner side, and a first stationary scroll blade projecting axially (parallel to a longitudinal axis of the pump) in a first direction from the outer side of the first stationary plate. The outer stationary plate scroll includes a second stationary plate having an outer side and an inner side, and a second stationary scroll blade projecting axially in a second direction, opposite the first direction, from the inner side of the second stationary plate.

The orbiting plate scroll is interposed between the inner and outer stationary plate scrolls and includes an orbiting plate having an outer side and an inner side, a first orbiting scroll blade projecting axially in the second direction from the inner side of the orbiting plate, and a second orbiting scroll blade projecting axially in the first direction from the outer side of the orbiting plate. The first orbiting scroll blade is juxtaposed with the first stationary scroll blade in the radial direction of the pump such that the first stationary scroll blade and the first orbiting scroll blade are nested, and the second orbiting scroll blade is juxtaposed with the second stationary scroll blade in the radial direction of the pump such that the second stationary scroll blade and the second orbiting scroll blade are nested. In addition, the central portion of the orbiting plate scroll is constituted by a central section of the orbiting plate and one part of the second orbiting scroll blade. The outer peripheral portion of the orbiting plate scroll is constituted by an annular section of the orbiting plate, the first orbiting scroll blade, and another part of the second orbiting scroll blade.

A tip seal is interposed between an axial end of the scroll blade of one of the first stationary and orbiting plate scrolls and the plate of the other of the first stationary and orbiting plate scrolls.

To change the tip seal of a multi-stage scroll pump according to an aspect the present invention, first, the pump head assembly of the pump is accessed. Then, the outer stationary plate scroll is detached from the frame and removed from the pump head assembly to access the orbiting plate scroll. Subsequently, the outer peripheral portion of the orbiting plate scroll is removed from the central portion of the orbiting plate scroll, while the central portion is left supported by the eccentric drive mechanism. As a result, the tip seal is exposed. The tip seal is removed from the groove in which it extends and a new tip seal is inserted into the groove. Next, the outer peripheral portion of the orbiting plate scroll is seated back on the central portion of the orbiting plate scroll. Finally, the outer stationary plate scroll to the frame is re-attached to the frame.

BRIEF DESCRIPTION OF THE DRAWINGS

These and other aspects, features and advantages of the present invention will become more clearly understood from the following detailed description of the preferred embodiments of the invention made with reference to the attached drawings, in which.

DETAILED DESCRIPTION OF THE PREFERRED EMBODIMENTS

Figure 1:
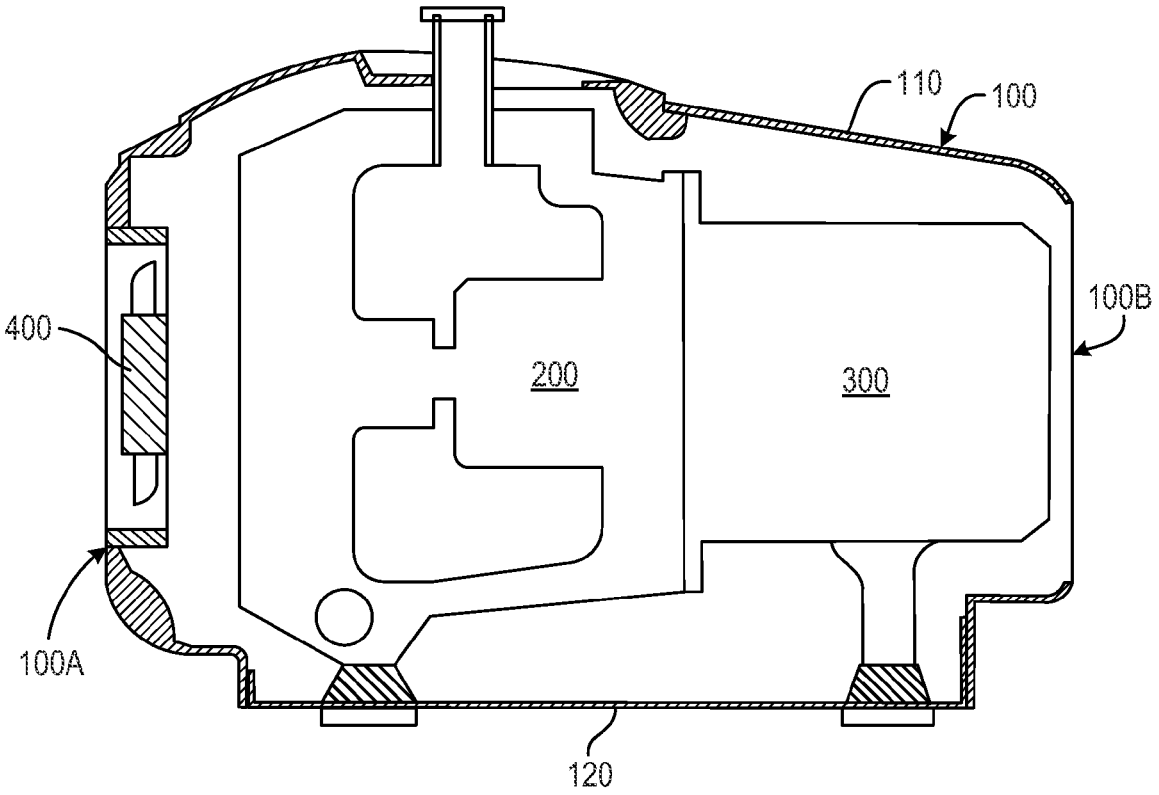
FIG. 1 is a schematic longitudinal sectional view of a scroll pump according to the inventive concept.

Various embodiments and examples of embodiments of the inventive concept will be described more fully hereinafter with reference to the accompanying drawings. In the drawings, the sizes and relative sizes of elements may be exaggerated for clarity. Likewise, the shapes of elements may be exaggerated and/or simplified for clarity and ease of understanding. Also, like numerals and reference characters are used to designate like elements throughout the drawings.

Furthermore, terminology used herein for the purpose of describing particular examples or embodiments of the inventive concept is to be taken in context. For example, the terms "comprises" or "comprising" when used in this specification indicates the presence of stated features or processes but does not preclude the presence of additional features or processes. The term "pump" may refer to apparatus that drives, or raises or decreases the pressure of a fluid, etc. The term "fixed" may be used to describe a direct connection of two parts to one another in such a way that the parts can not move relative to one another or a connection of the parts through the intermediary of one or more additional parts in such a way that the parts can not move relative to each other. Also, unless otherwise stated, the term "fixed" may describe a relationship between two unitary or integral parts of the pump and in the case of integral parts, does not preclude the possibility of one of the parts being detachable from the other. Finally, the term "scroll blade" will refer to a blade having the form of at least part of a spiral or coil.

Referring now to FIG. 1, in general, a scroll pump 1 to which the present invention can be applied includes a housing 100, and a pump head assembly 200, a pump motor 300, and a cooling fan 400 disposed in the housing 100. Furthermore, the housing 100 defines an air inlet 100A and an air outlet 100B at opposite ends thereof, respectively. The housing 100 may also include a cover 110 that covers the pump head assembly 200 and pump motor 300, and a base 120 that supports the pump head assembly 200 and pump motor 300. The cover 110 may be of one or more parts and is detachably connected to the base 120 such that the cover 110 can be removed from the base 120 to access the pump head assembly 200.

Figure 2A:
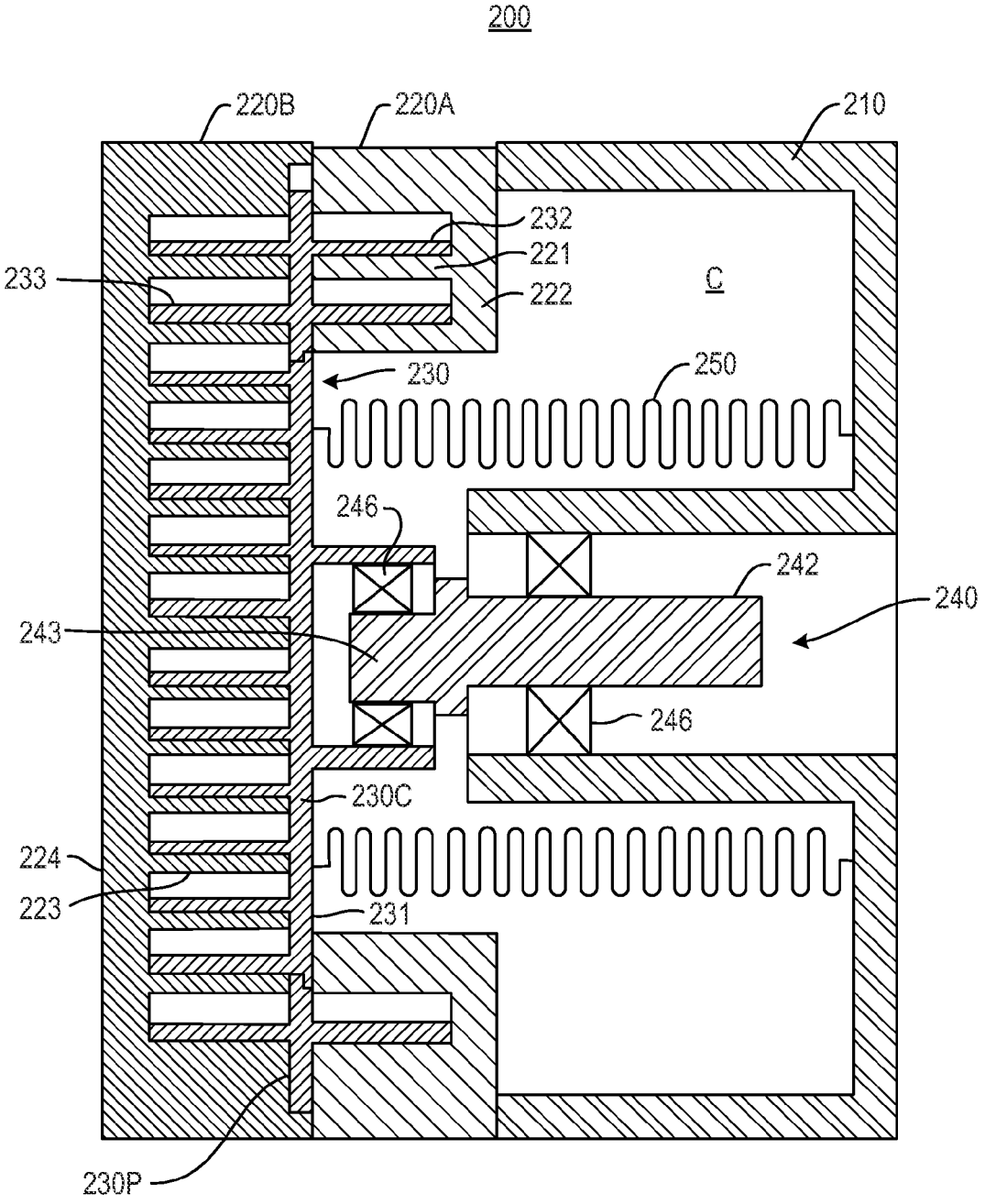
FIG. 2A is schematic longitudinal sectional view of a pump head assembly of the scroll pump of FIG. 1.

Referring to FIG. 2A, the pump head assembly 200 includes a frame 210, an inner (first) stationary plate scroll 220A, an orbiting plate scroll 230, an outer (second) stationary plate scroll 220B, an eccentric drive mechanism 240 driven as a result of a rotary output by the motor 300, a tubular member 250 and fasteners (not shown) fixing the stationary plate scrolls 220A and 220B to the frame 210 and the tubular member 250 to both the frame 210 and the orbiting plate scroll 2A. As shown in FIG. 2A, the outer stationary plate scroll 220B may be fixed to the frame 210 through the intermediary of the inner stationary plate scroll 220A.

Figure 6:
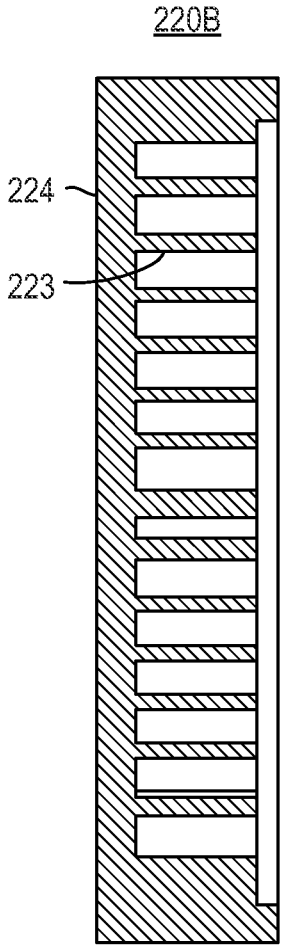
FIG. 6 is a longitudinal sectional view of an outer stationary scroll plate of a scroll pump according to the present invention.
Figure 7:
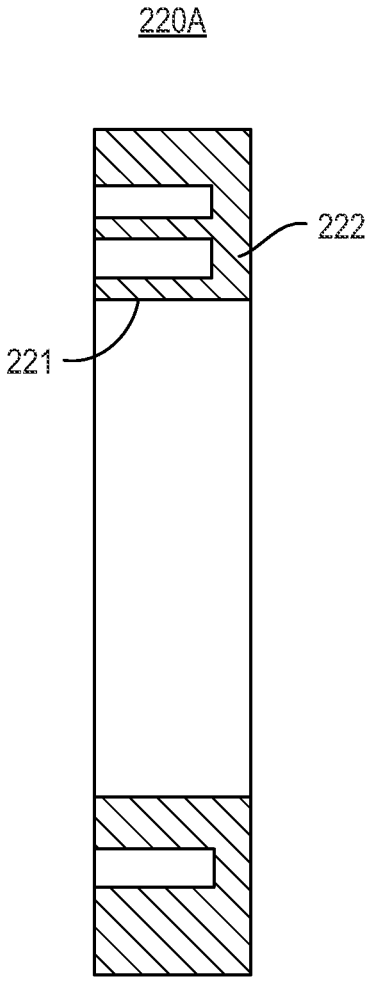
FIG. 7 is a longitudinal sectional view of an inner stationary scroll plate of a scroll pump according to the present invention.

The inner stationary plate scroll 220A (refer also to FIG. 7) includes a first stationary scroll blade 221 of the pump and a first stationary plate 222 having an outer (front) side and an inner (hack) side. The first stationary scroll blade 221 projects axially (parallel to a longitudinal axis of the pump) in a first direction from the outer side of the first stationary plate 222. The outer stationary plate scroll 220B (refer also to FIG. 6) includes a second stationary scroll blade 223 of the pump and a second stationary plate 224 having an outer (back) side and an inner (front) side. The second stationary scroll blade 223 projects axially in a second direction, opposite the first direction, from the inner side of the second stationary plate 224.

The orbiting plate scroll 230 is interposed between the inner and outer stationary plate scrolls 220A, 220B in the axial direction of the pump and is coupled to the eccentric drive mechanism 240 so as to be driven by the eccentric drive mechanism 240 in an orbit about the longitudinal axis of the pump. The orbiting plate scroll 230 includes an orbiting plate 231 having an outer side and an inner side, a first orbiting scroll blade 232 projecting axially in the second direction from the inner side of the orbiting plate 231, and a second orbiting scroll blade 233 projecting axially in the first direction from the outer side of the orbiting plate 231. The first orbiting scroll blade 232 is juxtaposed with the first stationary scroll blade 221 in the radial direction of the pump such that the first stationary scroll blade 221 and the first orbiting scroll blade 232 are nested. The second orbiting scroll blade 233 is juxtaposed with the second stationary scroll blade 223 of the pump in the radial direction of the pump such that the second stationary scroll blade 223 and the second orbiting scroll blade 233 are nested.

Referring to FIGS. 2A, 2B, 3 and 4, the orbiting plate scroll 230 has a central portion 230C and an outer peripheral portion 230P extending around and seated on the central portion 230C. In particular, the outer peripheral portion 230P of the orbiting plate scroll is keyed to and/or fastened to the central portion 230C such that the outer peripheral portion 230P can not rotate relative to the central portion 230C and yet is removable from the central portion 230C for reasons to be described later on.

Figure 2B:
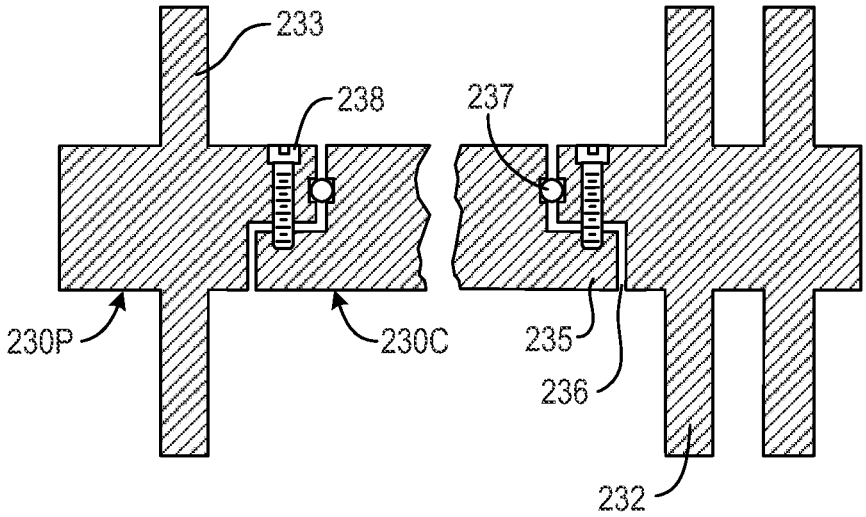
FIG. 2B is sectional of part of the orbiting plate scroll of the pump head assembly shown in FIG. 2A, illustrating a joint between central and outer peripheral portions of the orbiting plate scroll.

In the example of the keyed joint between the central and outer portions of the orbiting plate scroll 230, shown in FIGS. 2A and 2B, the central portion 230C of the orbiting plate scroll 230 has at least one spline 235 (two of which are shown in the figures) extending radially outwardly from its outer periphery. The outer peripheral portion 230P defines at least one complementary keyway 236 in its inner peripheral edge. Alternatively, the central portion 230C of the orbiting plate scroll 230 may define the keyways in its outer peripheral edge, and the outer peripheral portion 230P may have splines extending radially inwardly from its inner periphery. In either case, the splines 235 are received in the keyways 236, respectively, such that not only is the outer peripheral portion 230P of orbiting plate scroll 230 seated on the central portion 230C but such that the outer peripheral portion 230P of orbiting plate scroll 230 is also prevented from rotating relative to the central portion 230C.

In addition, a seal is provided between the outer peripheral edge of the central portion 230C of the orbiting scroll plate 230 and the inner peripheral edge of the peripheral portion 230P, where the central and outer peripheral portions are seated. The seal may be a labyrinth seal formed by the above-mentioned peripheral edges and/or may comprise a ring seal 237 interposed between the edges.

Referring still to FIG. 2B, fasteners 238 may be provided in addition to or as an alternative of the keyed joint described above, between the central and outer peripheral portions 230C, 230P of the orbiting plate scroll 230. In an example in which the fasteners 238 are provided as an alternative to the keyed joint, the central portion 230C of the orbiting plate scroll 230 may define an annular groove extending along its outer periphery, and the outer peripheral portion 230P may have a complementary annular projection received in the groove (or vice versa). The fasteners 238 may be machine screws extending through the annular projection of the outer peripheral portion 230P (or central portion) and into the central portion 230C (or peripheral portion) as threadingly engaged therewith to fasten the central and outer peripheral portions to one another. In either of these cases, as well, not only is the outer peripheral portion 230P of orbiting plate scroll 230 seated on the central portion 230C but the outer peripheral portion 230P of orbiting plate scroll 230 is also prevented by the fasteners 237 from rotating relative to the central portion 230C.

Figure 3:
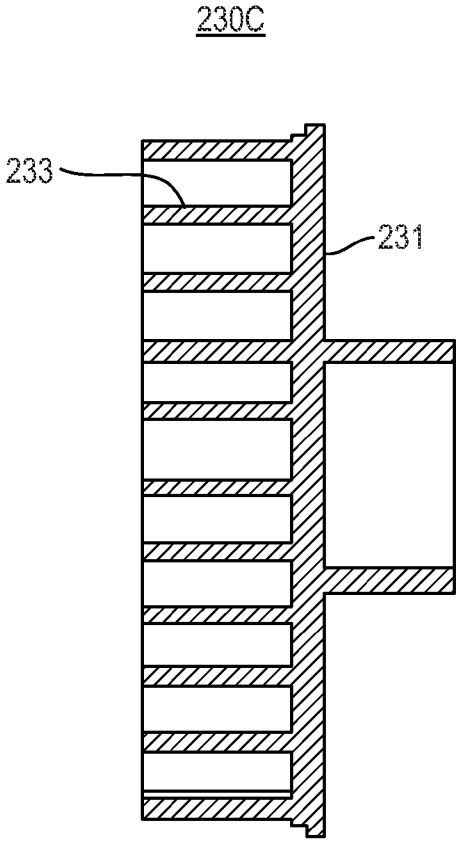
FIG. 3 is a longitudinal sectional view of a central portion of an orbiting scroll plate of a scroll pump according to the present invention.
Figure 4:
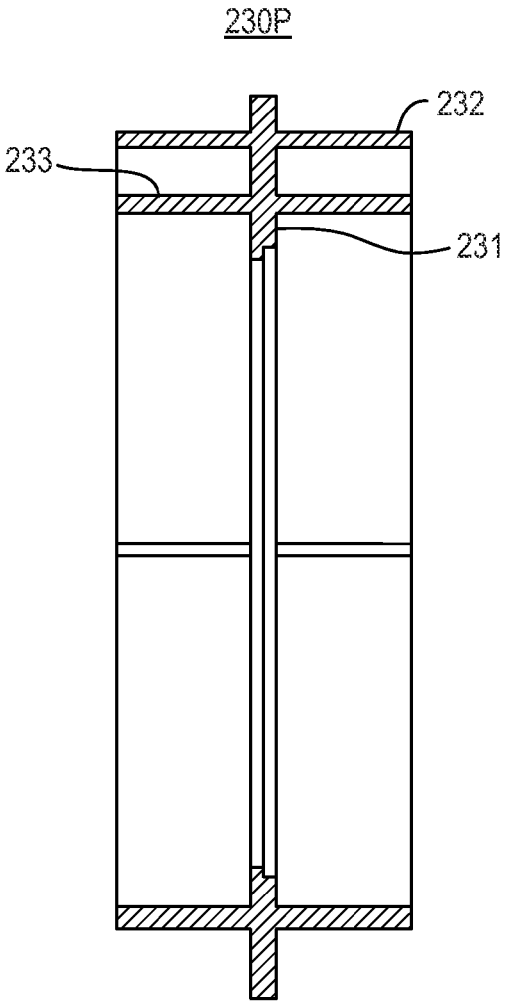
FIG. 4 is a longitudinal sectional view of an outer peripheral portion of the orbiting scroll plate of a scroll pump according to the present invention.
Figure 5:
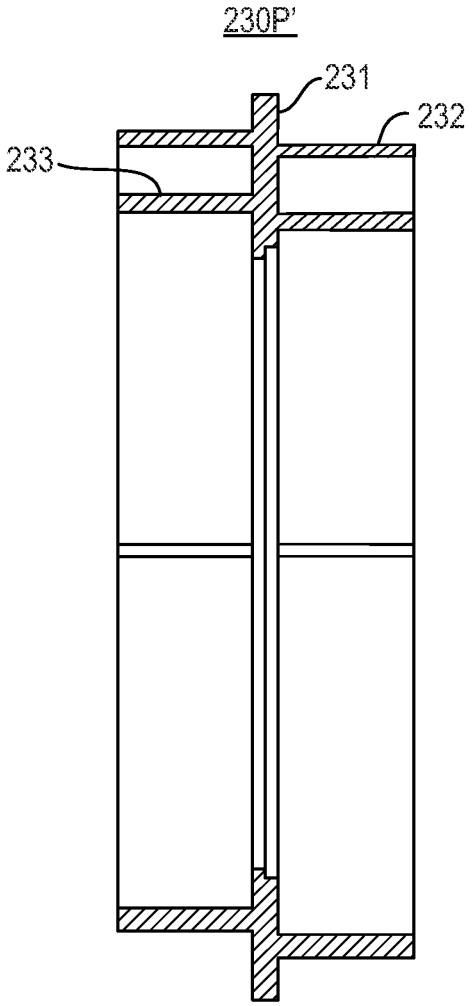
FIG. 5 is a longitudinal sectional view of another version of the outer peripheral portion of the orbiting scroll plate of a scroll pump according to the present invention.
Figure 8:
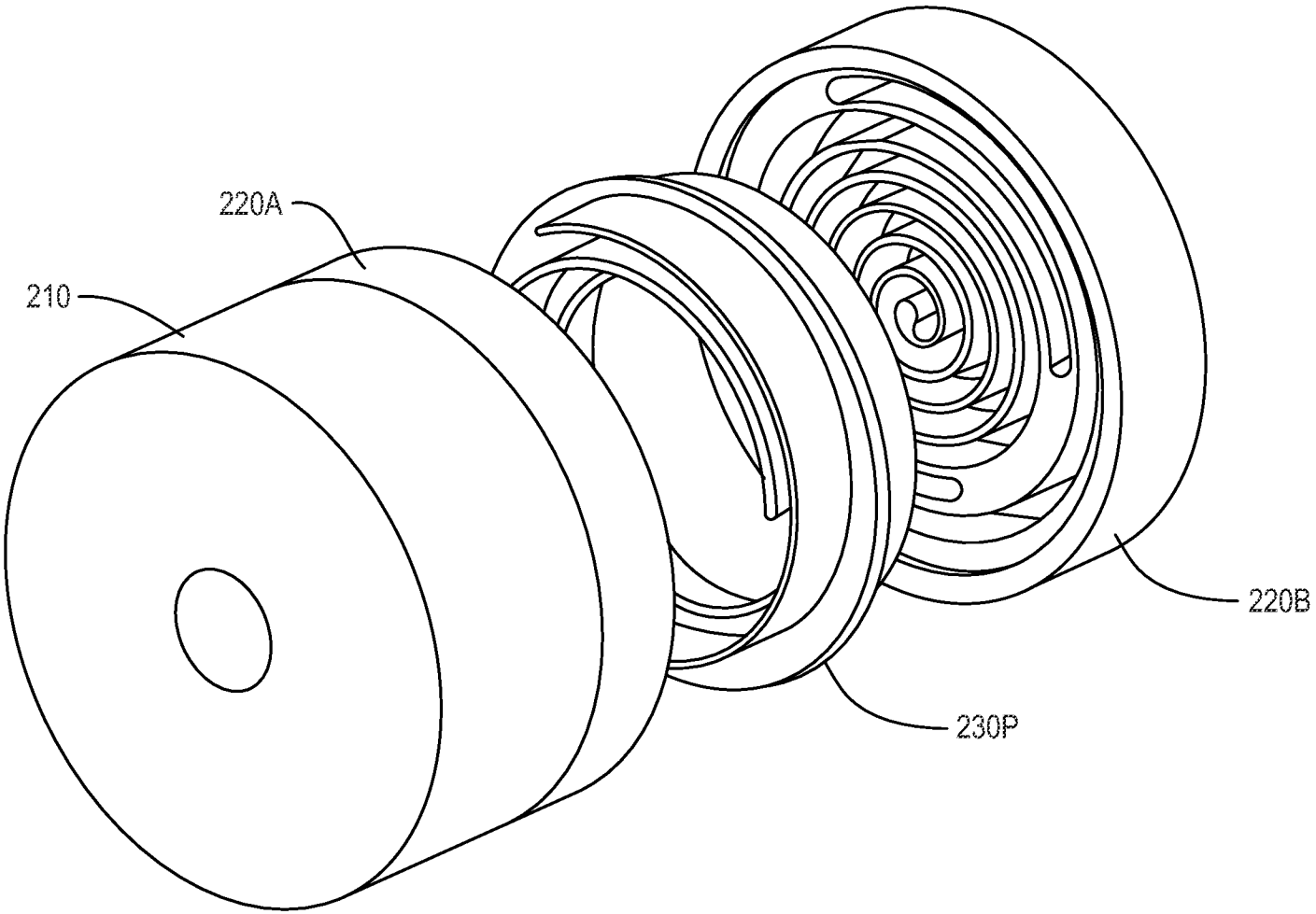
FIG. 8 is an exploded perspective view of selected components of a pump head assembly of a scroll pump, according to the present invention, from one end of the assembly.
Figure 9:
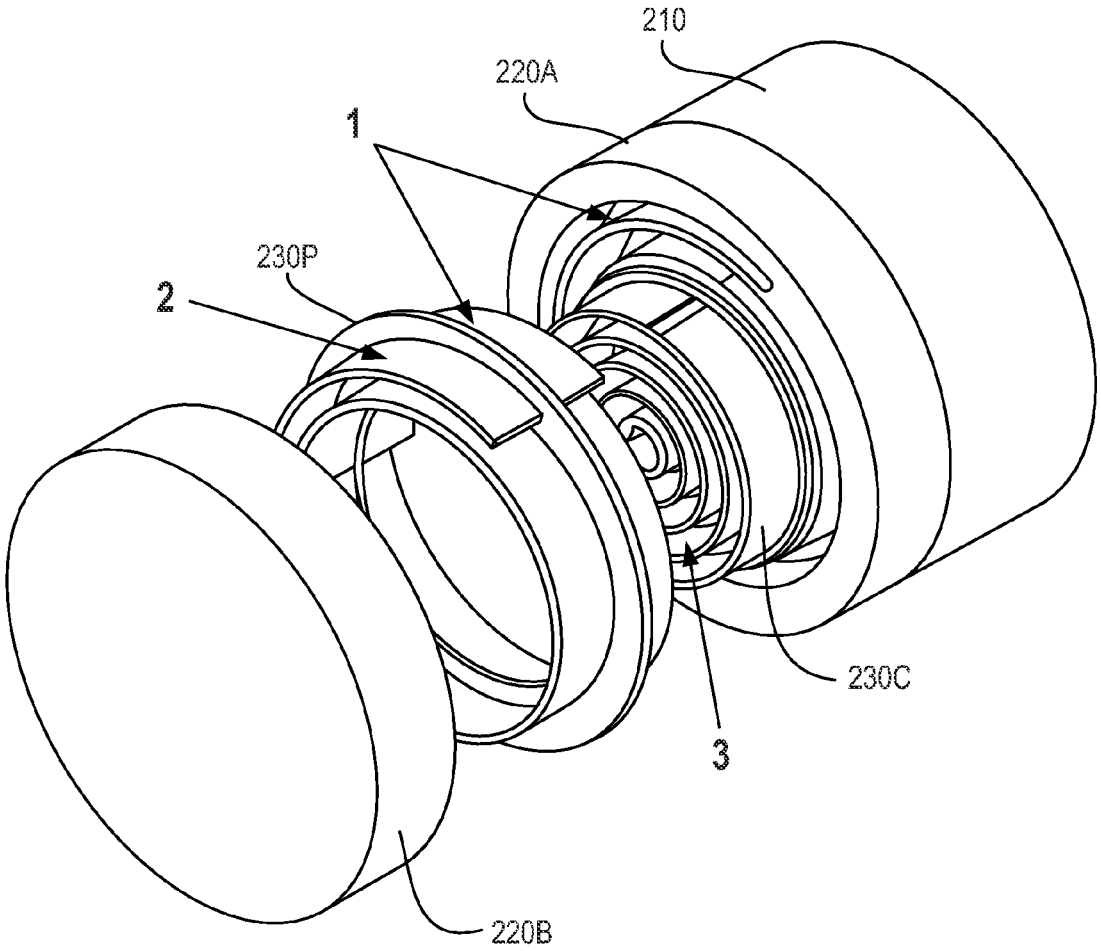
FIG. 9 is an exploded perspective view of selected components of a pump head assembly of a scroll pump, according to the present invention, from the other end of the assembly.

Moreover, as FIGS. 2A, 3 and 9 make clear, the central portion 230C of the orbiting plate scroll 230 is constituted by a central section of the orbiting plate 231 and one part of the second orbiting scroll blade 233. On the other hand, as is clear from FIGS. 2A, 4 and 8, the outer peripheral portion 230P of the orbiting plate scroll 230 is constituted by an annular section of the orbiting plate 231, the first orbiting scroll blade 232, and another part of the second orbiting scroll blade 233. Also, in the example shown in FIGS. 2A and 4, the first orbiting scroll blade 232 and the part of the second orbiting scroll blade 233 carried by the outer peripheral portion 230P of the orbiting plate scroll 230 are symmetrical about a plane extending in the radial direction of the pump through the orbiting plate 231. Alternatively, as shown in FIG. 5, the first orbiting scroll blade 232 and the part of the second orbiting scroll blade 233 carried by the outer peripheral portion 230P' of the orbiting plate scroll 230 may be asymmetrical about a plane extending in the radial direction of the pump through the orbiting plate 231.

Referring still to FIG. 2A, the eccentric drive mechanism 240 includes a drive shaft and bearings 246. In this example, the drive shaft is a crank shaft having a main portion 242 connected to and rotated by the motor 300 about the longitudinal axis of the pump 100, and a crank 243 whose central longitudinal axis is offset in a radial direction from the longitudinal axis. The bearings 246 may comprise a plurality of sets of rolling elements.

Also, in this example, the main portion 242 of the crank shaft is supported by the frame 210 via one or more sets of the bearings 246 so as to be rotatable relative to the frame 210. The orbiting plate scroll 230 is mounted to the crank 243 via another set or sets of the bearings 246. Thus, the orbiting plate scroll 230 is carried by crank 243 so as to orbit about the longitudinal axis of the pump when the main shaft 242 is rotated by the motor 300, and the orbiting plate scroll 230 is supported by the crank 243 so as to be rotatable about the central longitudinal axis of the crank 243. Furthermore, the inner stationary plate scroll 220A extends around the eccentric drive mechanism 240 and, in particular, the bearings 246 through which the orbiting plate scroll 230 is mounted to the crank 243.

The tubular member 250 has a first end at which it is fixed to the back side of the central portion 230C of the orbiting plate scroll 230, and a second end at which it is fixed to the frame 210. The tubular member 250 also extends around a portion of the crank shaft 243 and the bearings 246 of the eccentric drive mechanism 240. In this way, the tubular member 250 may also seal the bearings 246 and bearing surfaces from a space defined between the tubular member 250 and the frame 210 in the radial direction and which space may constitute the working chamber C, e.g., a vacuum chamber of the pump, through which fluid worked by the pump passes. Accordingly, lubricant employed by the bearings 246 and/or particulate matter generated by the bearings surfaces can be prevented from passing into the chamber C by the tubular member 250. The tubular member 250 is radially flexible enough to allow the first end thereof to follow along with the orbiting plate scroll 230 while the second end thereof remains fixed to the frame 210.

In the illustrated example, the tubular member 250 is a metallic bellows whose torsional stiffness prevents the first end thereof from rotating significantly about the central longitudinal axis of the bellows, i.e., from rotating significantly in its circumferential direction, while the second end of the bellows remains fixed to the frame 210. Accordingly, the metallic bellows 250 may be essentially the only means of providing the angular synchronization between the stationary scroll blades 221 and 223 and the first and second orbiting scroll blades 232 and 233, respectively, during the operation of the pump.

Figure 2C:
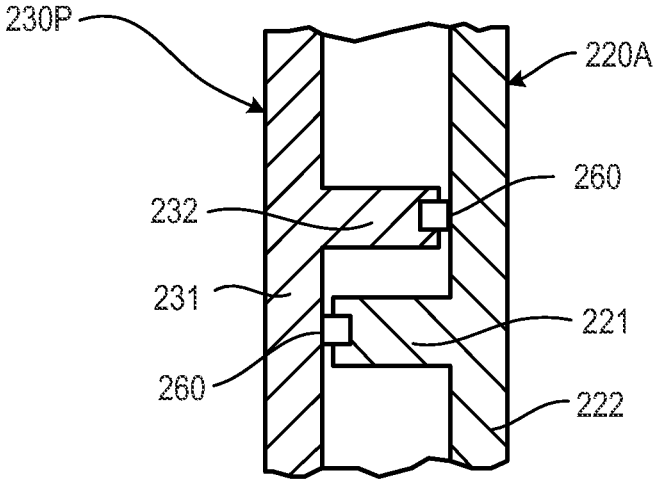
FIG. 2C is a sectional view of another part of the pump head assembly shown in FIG. 2A, illustrating tip seals between the inner stationary plate scroll and the orbiting plate scroll.

In addition, and although not shown in FIGS. 2A, 2B and 3-9 for the sake of simplicity, the scroll pump is a dry scroll pump including one or more tip seals each seated in a groove extending in and along the length of the tip (axial end) of a respective one of the scroll blades (the groove thus also having the form of the scroll). FIG. 2C shows at least one such tip seal 260 associated with the first stationary plate scroll 220A and the orbiting plate scroll 230 according to an aspect of the present invention. Each tip seal 260 is a plastic member interposed between the tip of the scroll blade 221, 232 of one of the first stationary and orbiting plate scrolls 220A, 230 and the plate 231, 222 of the other of the first stationary and orbiting plate scrolls 220A, 230.

As was mentioned above, the outer stationary plate scroll 220B is fixed to the frame 210 with fasteners. Thus, the outer stationary plate scroll 220B can be detached from the frame 210 to facilitate the replacing of the tip seal seal(s) 260 as will be described in more detail later on.

Next, however, a system of fluid flow paths in an example of a multi-stage scroll pump according to the present invention will be described in detail with reference to FIGS. 2A, 9 and 10A-D.

There are three regions 1, 2, and 3 in the scroll pump where pumping occurs. The first region 1 of the pump is defined between the outer peripheral portion 230P of the orbiting plate scroll 230 and the first stationary plate scroll. In region 1, therefore, the fluid is pumped by the action of the stationary scroll blade 221 of the inner stationary plate scroll 220A and the first orbiting scroll blade 221 constituting the outer peripheral portion 230B of the orbiting plate scroll 230. Here, the co-acting scroll blades are of limited extent, meaning that they are in the form of only outermost parts of spirals or coils. The second region 2 of the pump is defined between the outer peripheral portion 2300P of the orbiting plate scroll 230 and the outer stationary plate scroll 220B. In region 2, therefore, the fluid is pumped by the action of a radially outer part of the stationary scroll blade 223 and the radially outer part of the second orbiting scroll blade 233 constituting the outer peripheral portion 230P of the orbiting plate scroll 230. Here too, therefore, the co-acting scroll blades are of limited extent. Also, region 1 may be identical in form to region 2 or different. The third region 3 of the pump is defined between the central portion 230C of the orbiting plate scroll 230 and the outer stationary plate scroll 220B. In region 3, therefore, the fluid is pumped by the action of a radially inner part of the stationary scroll blade 223 and the radially inner part of the second orbiting scroll blade 233 constituting the central portion 230C of the orbiting plate scroll 230. Here, though, the co-acting scroll blades spiral in to near the center of the pump and are of a significant extent, meaning that they each have a number of wraps (e.g., at least four wraps) greater than the number of wraps (e.g., no more than two) of the co-acting scroll blades in regions 1 and 2. Fluid worked by the pump is discharged out of the pump head assembly from region 3.

An advantage of this multi-stage scroll pump according to the present invention is that it can be selectively configured as a two-stage or three-stage pump. Thus, both two-stage and three-stage scroll pumps can be manufactured using identical components and by simply closing or opening ports in the flow paths at the factory. This could be done by installing or removing inexpensive plugs.

Figure 10A:
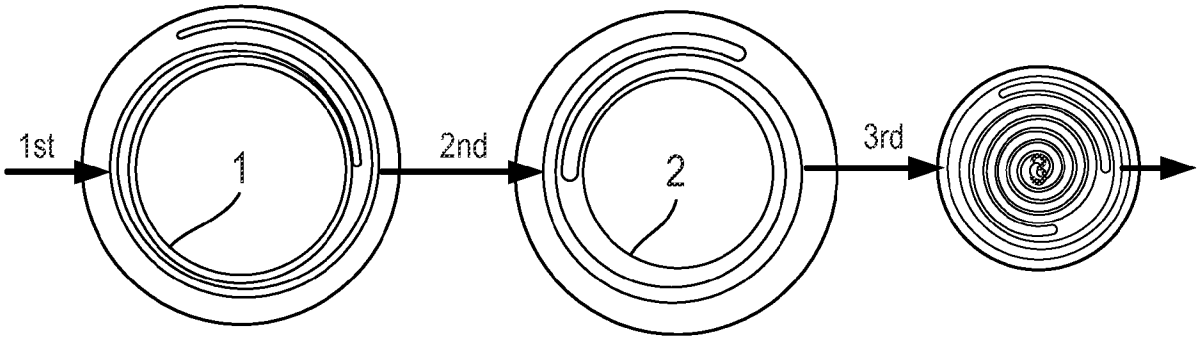
FIG. 10A is a schematic diagram of the plate scrolls of a multi-stage scroll pump according to the present invention, showing first, second and third fluid flow paths that may be established through the pump.

FIG. 10A shows the three regions 1, 2 and 3 configured for a three-stage operation. In this operational mode, regions 1, 2 and 3 are connected in series, i.e., the fluid paths include a first path along which the fluid can flow from the inlet of the pump to the first region 1, a second path along which the fluid can flow from the first region 1 to the second region 2, and a third path along which the fluid can flow from the second region 2 to the third region 3. Therefore, fluid may flow from an outlet of region 1 to an inlet of region 2, and from an outlet of region 2 to an inlet of region 3. This three-stage operational mode has lower displacement but a higher compression ratio than the two-stage operational mode.

Figure 10B:
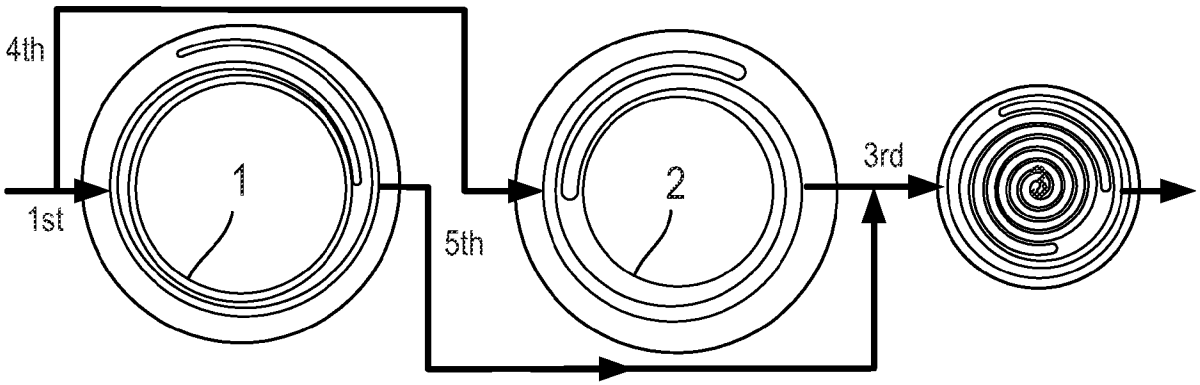
FIG. 10B is another schematic diagram of the plate scrolls of the multi-stage scroll pump according to the present invention, showing fourth and fifth fluid flow paths that may be established through the pump.

FIG. 10B shows the three regions 1, 2 and 3 configured for a two-stage operation. In this operational mode, regions 1 and 2 are connected in parallel. Thus, in addition to the first path, the fluid paths include a fourth path along which the fluid can flow from the inlet of the pump to the second region 2 while bypassing the first region 1, and a fifth path along which the fluid can flow from the first region 1 to the third region 3 while bypassing the second region 2. This two-stage operational mode offers the highest displacement and the lowest compression ratio. Also, in an example of this pump in which regions 1 and 2 have identical configurations, the pump would offer half the displacement in the three-stage operational mode than in the two-stage operational mode.

Figure 10C:
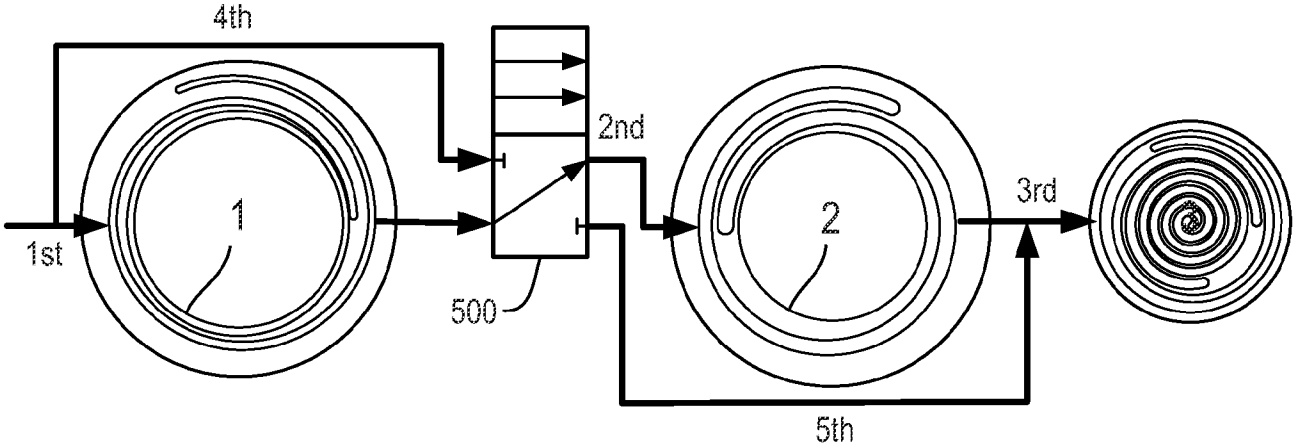
FIG. 10C is a schematic diagram of the multi-stage scroll pump in a three stage operational mode, according to the present invention.
Figure 10D:
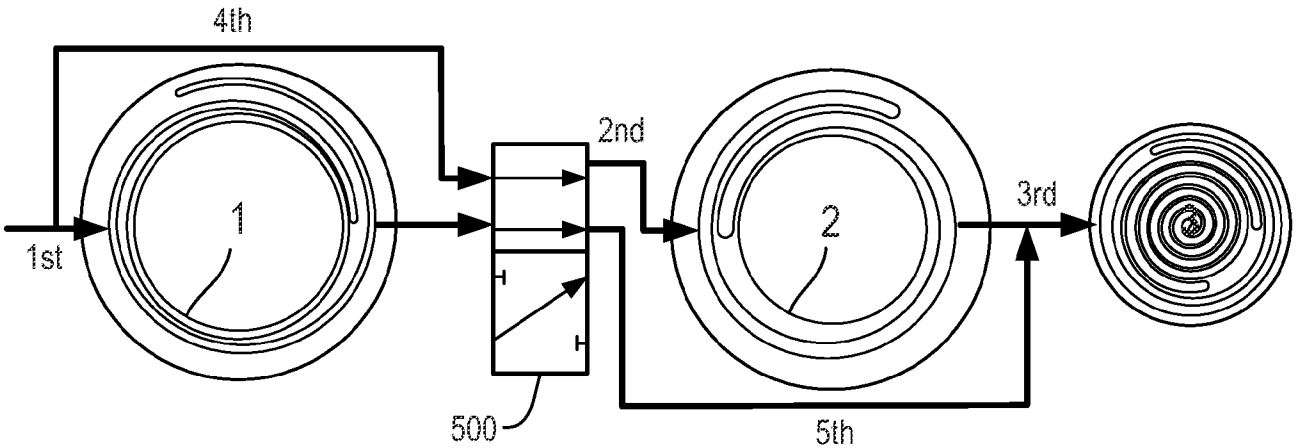
FIG. 10D is a schematic diagram of the multi-stage scroll pump in a two stage operational mode, according to the present invention.
Figure 11:
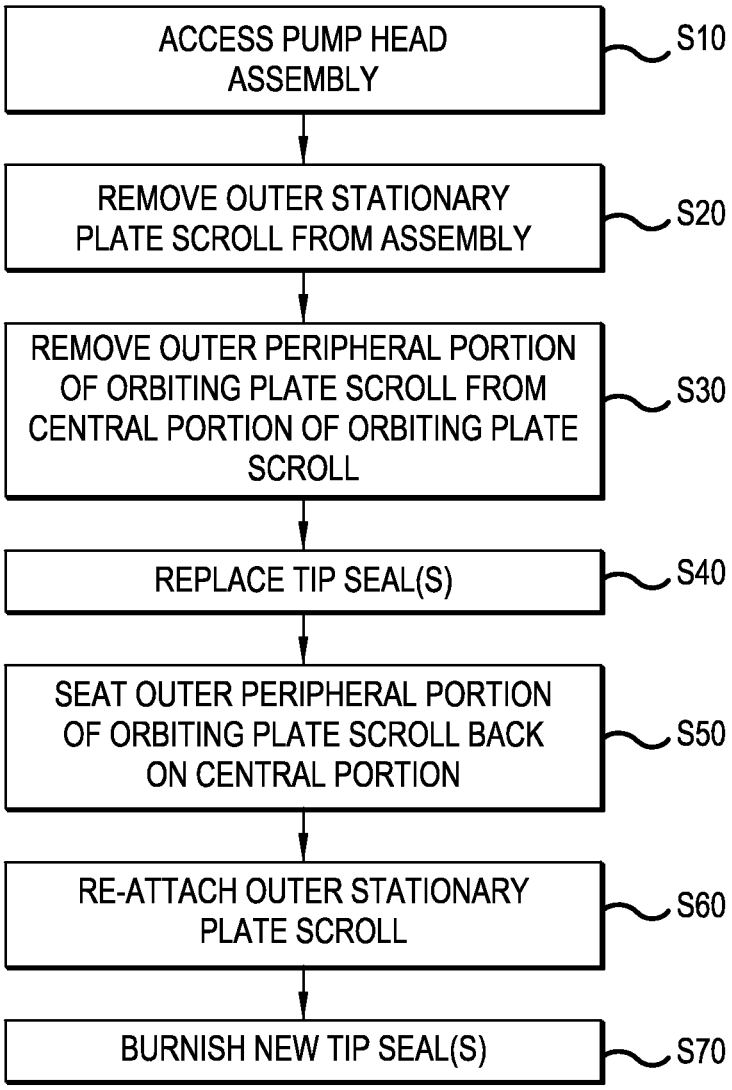
FIG. 11 is a flow chart showing a method of changing a tip seal in a multi-stage scroll pump according to the present invention.

Referring now to FIGS. 10C and 10D, the multi-stage scroll pump having the regions 1, 2 and 3 may also be provided with fluid flow control means including a control mechanism 500 that can selectively operate the pump in two-stage and three-stage operational modes. For example, the control mechanism is a three-way valve 500. As shown in FIG. 10C, the three-way valve 500 is movable to a first position, in which the first, second and third flow paths are open while the fourth and fifth flow paths are closed, to establish the three-stage operational mode. On the other hand, as shown in FIG. 10D, the three-way valve 500 is movable to a second position, in which the first, third, fourth and fifth flow paths are open while the second flow path is closed, to establish the two-stage operational mode.

The fluid control means may also include various sensors/controllers for controlling the control mechanism, e.g., for moving the three-way valve 500 to the positions shown in FIGS. 10C and 10D. For instance, a pressure sensor(s) may be operatively connected to the three-way valve 500 (or equivalent control mechanism) such that pressure of the fluid is used to set the position of and/or move the valve 500. Such a pressure sensor(s) may be provided at the inlet of the pump and/or at some point along one of the fluid paths. Alternatively, an external switch or the like may be operatively connected to the three-way valve 500 (or equivalent control mechanism) to set the position of and/or move the valve 500. Also, a solenoid or the like may be provided for the valve 500 so that the valve may be operated as the result of an electric signal produced by the pressure sensor or switch.

An advantage of using the valve 500 to alternate between the two-stage and three-stage operational modes is that it provides the opportunity for low ultimate pressure and high pumping speed (displacement) in a single package. A common application for vacuum pumps is to remove air from a chamber of some considerable volume. A subset of these applications also require the pressure inside the chamber to be reduced to a low level, near the minimum achievable with a dry rough pump, for example, less than 0.005 Torr. By providing control valve 500, the pump can be operated in the two-stage mode for maximum displacement during the early stages of pumping out a large chamber, when achieving a high mass flow rate is the primary requirement, then switched to the three-stage mode during the later stages, when mass flow rate is lower but achieving a high compression ratio is the primary requirement.

Referring now to FIGS. 1, 2A, 2C, 8, 9 and 11, a method of replacing a tip seal seal(s) 260 according to the present invention will be described in detail.

First, the pump head assembly 200 of the pump is accessed (S10). To this end, at least part of the housing 100 of the pump is removed from around the pump head assembly 200 and motor 300. Therefore, the housing 100 may include a base, e.g., a tray, that supports the pump head assembly 200 and motor 300, and a cover that covers the components of the pump such as the pump head assembly 200 and motor 300 and is removable from the base.

Next, the outer stationary plate scroll 220B is detached from the frame 210 and removed from the pump head assembly 200 to access the orbiting plate scroll 230 (S20).

Subsequently, the outer peripheral portion 230P of the orbiting plate scroll 230C is removed from the central portion 230C of the orbiting plate scroll 230, while leaving the central portion 230C supported by the eccentric drive mechanism 240 (S30). According to the examples described above, this may require removing the fasteners 238 fastening the outer peripheral portion 230P and the central portion 230C together, and pulling the outer peripheral portion 230P off of the central portion 230C in the axial direction. In any case, as a result, each tip seal 260 within the groove in an axial end of the scroll blade of one of the inner stationary plate scroll 220A and orbiting plate scroll 230 is exposed without the need to disassemble the tubular member 250, bearings 246 etc.

Then the worn out tip seal(s) 260 is/are removed and a new tip seal(s) is/are installed (inserted into the groove(s) in the axial end(s) of the scroll blade(s) (S40).

Next, the outer peripheral portion 230P of the orbiting plate scroll 230 is seated back on the central portion 230C (S50) and fastened thereto if necessary, and the outer stationary plate scroll 220B is re-attached to the frame 210 (S60).

Then the housing 100 is placed back over the pump head assembly 200 and motor 300. A burnishing operation (S70), in which the pump is run to wear in the new tip seal(s) 260, may then be carried out.

Finally, embodiments of the inventive concept and examples thereof have been described above in detail. The inventive concept may, however, be embodied in many different forms and should not be construed as being limited to the embodiments described above. Rather, these embodiments were described so that this disclosure is thorough and complete, and fully conveys the inventive concept to those skilled in the art. Thus, the true spirit and scope of the inventive concept is not limited by the embodiment and examples described above but by the following claims.

What is claimed is:

1. A scroll pump comprising:

a frame;

an eccentric drive mechanism supported by the frame;

an inner stationary plate scroll fixed to the frame and including a stationary plate having an outer side and an inner side, and a stationary scroll blade projecting axially in a first direction parallel to a longitudinal axis of the pump from the outer side of the stationary plate;

an orbiting plate scroll including an orbiting plate having an outer side and an inner side, and an orbiting scroll blade projecting axially in a second direction, parallel to the longitudinal axis of the pump and opposite the first direction, from the inner side of the orbiting plate, the orbiting scroll blade being juxtaposed with the stationary scroll blade in a radial direction of the pump such that the stationary and orbiting scroll blades are nested, the orbiting plate scroll being coupled to the eccentric drive mechanism so as to be driven by the eccentric drive mechanism in an orbit about the longitudinal axis of the pump, and the orbiting plate scroll having a central portion and an outer peripheral portion extending around and seated on the central portion so as to be non-rotatable relative to but axially removable from the central portion, the central portion comprising a central section of the orbiting plate at which the eccentric drive mechanism is connected to the orbiting plate scroll, and the outer peripheral portion comprising the orbiting scroll blade, and an annular section of the orbiting plate; and a tip seal interposed between an axial end of the scroll blade of one of the inner stationary and orbiting plate scrolls and the plate of the other of the inner stationary plate and orbiting plate scrolls, whereby the tip seal is accessible by removing the outer peripheral portion of the orbiting plate scroll from the central portion thereof.

2. The scroll pump as claimed in claim 1, wherein the stationary plate is annular and the inner stationary plate scroll extends around the eccentric drive mechanism.

3. The scroll pump as claimed in claim 2, wherein the eccentric drive mechanism includes a crank shaft including a crank having an axial center that is offset relative to the longitudinal axis, and a set of bearings by which the orbiting scroll plate is mounted to the crank, and the inner stationary plate scroll extends around the bearings.

4. The scroll pump as claimed in claim 1, further comprising a tubular member having first and second ends, the tubular member being fixed at the first end thereof to the frame, and at the second end thereof to the central section of the orbiting plate at the inner side of the orbiting plate.

5. The scroll pump as claimed in claim 4, wherein the tubular member is a metallic bellows.

6. The scroll pump as claimed in claim 4, wherein the eccentric drive mechanism includes a crank shaft including a crank having an axial center that is offset relative to the longitudinal axis, and a set of bearings by which the orbiting scroll plate is mounted to the crank, the tubular member surrounds the bearings, and the stationary plate is annular and the inner stationary plate scroll extends around the tubular member.

7. The scroll pump as claimed in claim 6, wherein the tubular member is a metallic bellows.

8. The scroll pump as claimed in claim 1, wherein the outer peripheral portion of the orbiting plate scroll is keyed to the central portion thereof.

9. The scroll pump as claimed in claim 1, further comprising fasteners detachably fastening the outer peripheral portion of the orbiting plate scroll to the central portion thereof.

10. The scroll pump as claimed in claim 1, wherein an inner peripheral edge of the outer peripheral portion of the orbiting plate scroll is seated on an outer peripheral edge of the central portion of the orbiting plate scroll, and further comprising a seal between the outer peripheral edge of the central portion of the orbiting scroll plate and the inner peripheral edge of the outer peripheral portion.

11. A multi-stage scroll pump comprising:

a frame;

an eccentric drive mechanism supported by the frame;

an inner stationary plate scroll fixed to the frame and including a first stationary plate having an outer side and an inner side, and a first stationary scroll blade projecting axially in a first direction parallel to a longitudinal axis of the pump from the outer side of the first stationary plate;

an outer stationary plate scroll detachably mounted to the frame, and including a second stationary plate having an outer side and an inner side, and a second stationary scroll blade projecting axially in a second direction, parallel to the longitudinal axis and opposite the first direction, from the inner side of the second stationary plate;

an orbiting plate scroll interposed between the inner and outer stationary plate scrolls and including an orbiting plate having an outer side and an inner side, a first orbiting scroll blade projecting axially in the second direction from the inner side of the orbiting plate, and a second orbiting scroll blade projecting axially in the first direction from the outer side of the orbiting plate, the first orbiting scroll blade being juxtaposed with the first stationary scroll blade in a radial direction of the pump such that the first stationary scroll blade and the first orbiting scroll blade are nested, the second orbiting scroll blade being juxtaposed with the second stationary scroll blade in the radial direction of the pump such that the second stationary scroll blade and the second orbiting scroll blade are nested, the orbiting plate scroll being coupled to the eccentric drive mechanism so as to be driven by the eccentric drive mechanism in an orbit about the longitudinal axis of the pump, and the orbiting plate scroll having a central portion, and an outer peripheral portion extending around and seated on the central portion so as to be non-rotatable relative to but axially removable from the central portion, the central portion comprising a central section of the orbiting plate and at which the eccentric drive mechanism is connected to the orbiting plate scroll, and one part of the second orbiting scroll blade, and the outer peripheral portion comprising an annular section of the orbiting plate, the first orbiting scroll blade, and another part of the second orbiting scroll blade; and a tip seal interposed between an axial end of the scroll blade of one of the first stationary and orbiting plate scrolls and the plate of the other of the first stationary and orbiting plate scrolls, whereby the tip seal is accessible by removing the outer stationary plate scroll from the frame to access the orbiting plate scroll, and then removing the outer peripheral portion of the orbiting plate scroll from the central portion of the orbiting plate scroll.

12. The multi-stage scroll pump of claim 11, wherein the first orbiting scroll blade and said another part of the second orbiting scroll blade are symmetrical about a plane extending in the radial direction of the pump through the orbiting plate.

13. The multi-stage scroll pump of claim 11, wherein the first orbiting scroll blade and said another part of the second orbiting scroll blade are asymmetrical about a plane extending in the radial direction of the pump through the orbiting plate.

14. The multi-stage scroll pump as claimed in claim 11, wherein the outer peripheral portion of the orbiting plate scroll is keyed to the central portion thereof.

15. The multi-stage scroll pump as claimed in claim 11, further comprising fasteners detachably fastening the outer peripheral portion of the orbiting plate scroll to the central portion thereof.

16. The multi-stage scroll pump as claimed in claim 11, wherein an inner peripheral edge of the outer peripheral portion of the orbiting plate scroll is seated on an outer peripheral edge of the central portion of the orbiting plate scroll, and further comprising a seal between the outer peripheral edge of the central portion of the orbiting plate scroll and the inner peripheral edge of the outer peripheral portion.

17. The multi-stage scroll pump of claim 11, and having fluid flow paths along which fluid being worked by the pump can selectively flow from an inlet of the pump to an outlet of the pump, and wherein the fluid flow paths include a first path along which the fluid can flow from the inlet of the pump to a first region of the pump defined between the outer peripheral portion of the orbiting plate scroll and the inner stationary plate scroll, a second path along which the fluid can flow from the first region of the pump to a second region of the pump defined between the outer peripheral portion of the orbiting plate scroll and the outer stationary plate scroll, a third path along which the fluid can flow from the second region of the pump to a third region of the pump defined between the central portion of the orbiting plate scroll and the outer stationary plate scroll, a fourth path along which the fluid can flow from the inlet of the pump to the second region of the pump while bypassing the first region of the pump, and a fifth path along which the fluid can flow from the first region of the pump to the third region of the pump while bypassing the second region of the pump.

18. The multi-stage scroll pump of claim 17, further comprising fluid flow control means for selectively placing the pump in a three-stage operational mode in which the first, second and third flow paths are open while the fourth and fifth flow paths are closed, and a two-stage operational mode in which the first, third, fourth and fifth flow paths are open while the second flow path is closed.

19. The multi-stage scroll pump of claim 17, wherein the flow control means comprises a three-way valve.

20. A method of changing a tip seal of a multi-stage scroll pump, comprising:

accessing a pump head assembly of the pump which has a frame, an inner stationary plate scroll fixed to the frame, an outer stationary plate scroll fixed to the frame, and an orbiting plate scroll interposed between the inner and outer stationary plate scrolls and having a central portion at which the orbiting plate scroll is supported by an eccentric drive mechanism;

detaching the outer stationary plate scroll from the frame and removing it from the pump head assembly to access the orbiting plate scroll;

subsequently removing an outer peripheral portion of the orbiting plate scroll from the central portion of the orbiting plate scroll, while leaving the central portion supported by the eccentric drive mechanism, to thereby expose a tip seal at an axial end of the scroll blade of one of the inner stationary and orbiting plate scrolls;

replacing the tip seal at the axial end of the scroll blade with a new tip seal;

seating the outer peripheral portion of the orbiting plate scroll back on the central portion of the orbiting plate scroll; and re-attaching the outer stationary plate scroll to the frame.

* * * * *